United States Patent [19]

Schillinger et al.

[11] Patent Number: 4,773,542

[45] Date of Patent: Sep. 27, 1988

[54] FLIP TOP SEALED CARTON

[75] Inventors: Joseph F. Schillinger, Fulton; Harry I. Roccaforte, Western Springs, both of Ill.; Randy J. Tiesman, Clinton, Iowa

[73] Assignee: Waldorf Corporation, St. Paul, Minn.

[21] Appl. No.: 81,856

[22] Filed: Aug. 5, 1987

[51] Int. Cl.[4] ..... B65D 5/54

[52] U.S. Cl. ..... 206/626; 206/631; 206/607; 229/905

[58] Field of Search ..... 206/607, 604, 605, 608, 206/620, 621, 626, 611, 631; 229/DIG. 7, 905

[56] References Cited

U.S. PATENT DOCUMENTS

| | | | |
|---|---|---|---|
| 3,144,980 | 8/1964 | Carson | 206/611 |
| 3,219,257 | 11/1965 | Anderson | 206/611 |
| 3,265,285 | 8/1966 | Fanter | 206/626 |
| 3,506,184 | 4/1970 | Barnes | 206/608 |
| 3,981,434 | 9/1976 | Ramich | 229/905 |
| 4,150,748 | 4/1979 | Mueller | 206/611 |
| 4,239,115 | 12/1980 | Froom | 206/611 |
| 4,289,239 | 9/1981 | Meyers | 206/625 |
| 4,386,705 | 6/1983 | Meuller | 206/624 |
| 4,431,129 | 2/1984 | Froom | 206/611 |
| 4,526,563 | 7/1985 | Froom | 493/151 |
| 4,712,689 | 12/1987 | Froom | 206/626 |

*Primary Examiner*—Willis Little

*Attorney, Agent, or Firm*—Dorsey & Whitney

[57] ABSTRACT

A rectangular box carton according to the present invention has generally rectangular front, bottom, back, cover and closure panels. The front, bottom, back, cover and closure panels are consecutively joined at parallel fold lines and the closure panel is overlapped on and connected to said front panel to form a tube of generally rectangular cross section. Left and right endwalls close the ends of the tube. Each endwall has a first endwall flap attached to the bottom panel and covering substantially the entire tube cross section to form the innermost layer of each endwall; a second endwall flap attached to the cover panel and overlying the first endwall flap, said second endwall flap overlapping only an upper portion of the first endwall flap; a third endwall flap attached to the rear panel and overlying a portion of the first and second endwall flaps, the third endwall flap covering only the rear portion of said first and second endwall flaps and having a glue shield extension thereon that covers an additional portion of the second endwall flap; a fourth endwall flap attached to the front panel and overlapping a portion of the first and second endwall flaps and the glue shield extension of the third endwall flap, the fourth endwall flap having a connection notch therein near the corner at which the cover and closure panels are joined, said notch exposing the corner of the second endwall flap nearest the closure panel; and a fifth endwall flap attached to the closure panel, said fifth endwall flap overlying at least a portion of that corner of the second endwall flap that is exposed by the connection notch.

14 Claims, 3 Drawing Sheets

FLIP TOP SEALED CARTON

BACKGROUND OF THE INVENTION

1. Field of the Invention

The present invention relates generally to rectangular box cartons that open by lifting a hinged top or cover panel and a blank for forming such a carton. More particularly, the present invention relates to a "flip-top" rectangular box carton in which the cover panel is connected to a closure panel that seals the carton. The cover panel also has endwall insertion panels that may be inserted in the endwalls but are not glued in position.

2. Description of the Prior Art

Cartons for ice creams and other frozen desserts generally are made in half-gallon sizes and in one of two shapes: round boxes or rectangular boxes. In the rectangular box shape, the carton usually comes in one of two styles. First, it may be formed from an unglued blank shaped on a mandrel, then glued at its four corners. The resulting open-top box is filled through the wide opening at the top, then the hood or cover is sealed around the upper perimeter of the box. This forms a large "flip top" opening for the customer, a carton configuration referred to as the "Kliklok" style structure, named for the machinery used to form and close the carton. Second, rectangular box cartons may be preglued along a glue flap at one long edge, then filled from a small end opening. In this case, the glue flap (along one of the long edges) of the carton acts as the opener or one of the end flaps is lifted to open the carton. The end flaps are usually locked by interlocking flap notches. While opening the carton at the glue flap gives a large "flip top" type opening, this opening cannot be easily reclosed. An opening at locked end flaps provides reclosing capability, but the smaller opening is less convenient for dipping.

The conventional equipment that locks the ends of rectangular cartons is fairly simple and has been in existence for many years (e.g., Anderson Model No. 555, made by APV Anderson Brothers Inc., 1303 Samuelson Road, Rockford, IL 61109). Many dairies have more than one such item of equipment in their plants. Recently, an inexpensive attachment that seals carton ends (primarily for tamper evidence) instead of locking them has also become available, but no adapter yet exists that permits the older, equipment augmented by the end sealer to make a reclosable flip top carton of the first style discussed above. New equipment that can both form flip-top cartons and also seal the ends is available but costly; it currently requires completely replacing the older equipment that is in the dairy and therefore involves a considerable investment. Often dairies are not in a position to replace their efficient, simple machines with the more expensive, complex ones, strictly to have carton ends glued and to provide a flip top opening for dispensing the ice cream or other product.

Accordingly, what is needed to improve the prior art is a carton design processable on conventional packaging equipment with end flaps and glue flaps configured to allow the customer to easily open the carton and to dispense ice cream through a flip-top closure. In addition, it is desirable to be able to seal the ends of any such new carton by utilizing an economical sealing attachment with the conventional end-locking rectangular carton packaging equipment. Such equipment characteristically folds end flaps in the following order: bottom, top, back, front (carton viewed in normal position for flipping top open).

SUMMARY OF THE INVENTION

A rectangular box carton according to the present invention comprises generally rectangular front, bottom, back, cover and closure panels, said front, bottom, back, cover and closure panels being consecutively joined at parallel fold lines and said closure panel being overlapped on and connected to said front panel to form a tube of generally rectangular cross section. Left and right endwalls close the ends of the tube. Each endwall comprises: a first endwall flap attached to said bottom panel and covering substantially the entire tube cross section to form the innermost layer of each endwall; a second endwall flap attached to said cover panel and lying adjacent said first endwall flap, said second flap overlapping only an upper portion of the first endwall flap; a third endwall flap attached to said rear panel and overlying a portion of said first and second endwall flaps, said third endwall flap covering only the rear portion of said first and second endwall flaps and having a glue shield extension thereon that covers an additional portion of said second endwall flap; a fourth endwall flap attached to said front panel and overlapping a portion of said first and second endwall flaps and the glue shield extension of the third endwall flap, said fourth endwall flap having a notch therein near the corner at which the cover and closure panels are joined, said notch exposing the corner of said second endwall flap nearest the closure panel; and a fifth endwall flap attached to said closure panel, said fifth endwall flap covering and being affixed to at least a portion of that corner of the second endwall flap that is exposed by the notch. A first linear glue strip is applied to said fourth endwall flap parallel to the fold line at which said fourth endwall flap is attached to the front panel. The first glue strip affixes said fourth endwall flap to the first endwall flap and to the glue shield extension of the third endwall flap but not to the second endwall flap. A second linear glue strip is applied to said fourth endwall flap and the fifth endwall flap parallel to the fold line at which said fourth endwall flap is attached to the front panel. The second glue strip affixes said fourth endwall flap to the first endwall flap and said fifth endwall flap to the second endwall flap. A pre-glued tear flap is located at the outer edge of said closure panel and affixed to said front panel, said tear flap forming a connection between said front panel and closure panel until said closure panel is released from said front panel upon opening of the carton.

It is an objective of the present invention to provide a flip top rectangular box carton with tamper-evident sealing that is closed with the same flap folding sequence as used by conventional end-locking equipment, thereby retaining the same filling method and ability to process cartons at essentially the same speed.

It is another objective of the invention to provide a flip top rectangular box carton that can be easily opened and reclosed by the end user.

It is a further objective of the present invention to provide a carton design that permits a flip-top rectangular carton with sealed ends to be processed on conventional end-locking equipment augmented with an inexpensive end-seal adapter.

These and other objectives of the invention will become clearer in the following detailed discussion of the preferred embodiment of the invention, including the following drawings.

DESCRIPTION OF THE PREFERRED EMBODIMENTS

Figure 1:
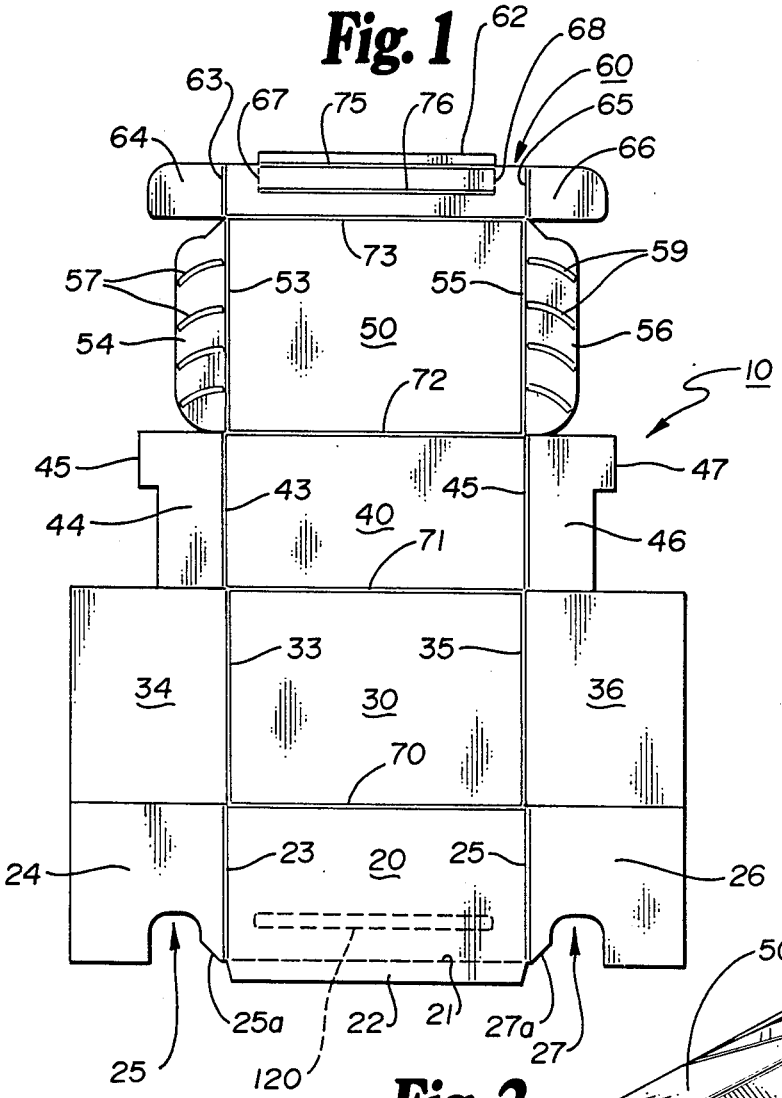
FIG. 1 is a plan view of a flat carton blank in accordance with the invention before it is assembled.

As seen in FIG. 1, the carton is made from a flat blank 10 consisting of several panels joined consecutively at four parallel fold lines. In particular, the carton blank 10 in its preferred embodiment consists of a front panel 20, a bottom panel 30, a back panel 40, a cover panel 50 and closure panel 60, each with its own auxiliary flaps and features to be described.

Turning first to the front panel 20, it consists of a generally rectangular panel 20 attached at a first major fold line 70 to bottom panel 30. Opposite and parallel to the fold line 70 is a narrow selvage flap 22 (optional, but present in the preferred embodiment to aid in preventing sifting of product) separated from the main portion of the front panel 20 at a perforated line 21 parallel to fold line 70. At opposing parallel side fold lines 23, 25 of the front panel 20 symmetrical, generally rectangular, right and left front endwall flaps 24, 26, respectively, are attached. Both front endwall flaps 24, 26 include a generally U-shaped notch 25, 27, respectively, that incorporates an angle cut **25*a*, 27*a*, respectively. Adhesives are applied to the front panel 20 and to the front endwall flaps 24, 26 during assembly and filling of the blank 10**, as will be explained later.

One side of the generally rectangular bottom panel 30 is attached to the front panel 20 at a first major fold line 70. At an opposing, parallel, second major fold line 71 the bottom panel 30 is also attached to the back panel 40. At opposing parallel side fold lines 33, 35, symmetrical, generally rectangular, left and right bottom endwall flaps 34, 36, respectively, are attached to the bottom panel 30.

One side of the generally rectangular back panel 40 is attached to bottom panel 30 at the second major fold line 71. Back panel 40 is also attached to the cover panel 50 at an opposing, parallel, third major fold line 72. At opposing, parallel side fold lines 43, 45, symmetrical, left and right back endwall flaps or bolsters 44, 46, respectively, are attached to back panel 40. Each such back endwall flap 44, 46 is generally rectangular, but has a glue shield extension 45, 47, respectively, incorporated at its outer edge.

The cover panel 50 is generally rectangular and is attached both to the back panel 40 at a third major fold line 72 and to the closure panel 60 at the fourth major fold line 73 parallel to fold line 72. At opposing parallel side fold lines 53, 55 of the cover panel 50, symmetrical, left and right cover endwall insertion flaps 54, 56, respectively, are attached to the cover panel 50. The left cover endwall insertion flap 54 includes a series of radial embossments 57. The right cover endwall insertion flap 56 includes a similar set of radial embossments 59.

The closure panel 60 is attached to the cover panel 50 at the fourth major fold line 73. It also includes at opposing parallel fold lines 63, 65 symmetrical right and left closure endwall flaps 64, 66, respectively. In addition, the closure panel 60 incorporates a tear flap lip 62 extending outwardly from a bend score 75. The closure panel 60 further includes a parallel set of left and right perforation lines 67, 68, respectively, that extend from the edges of the lip 62 perpendicular to the direction of the fourth major fold line 73. These perforation lines 67, 68 terminate at an internal bend score line 76.

The carton blank 10 will normally be sealed (by the carton manufacturer) to form a collapsed tube by application of adhesive 120 to the outside of front panel 120, prior to folding at major fold lines 70, and 72 to form the collapsed tube. The tube form of the blank 10 is then shipped flat for assembly and filling to a dairy or other frozen dessert manufacturer.

Figure 2:
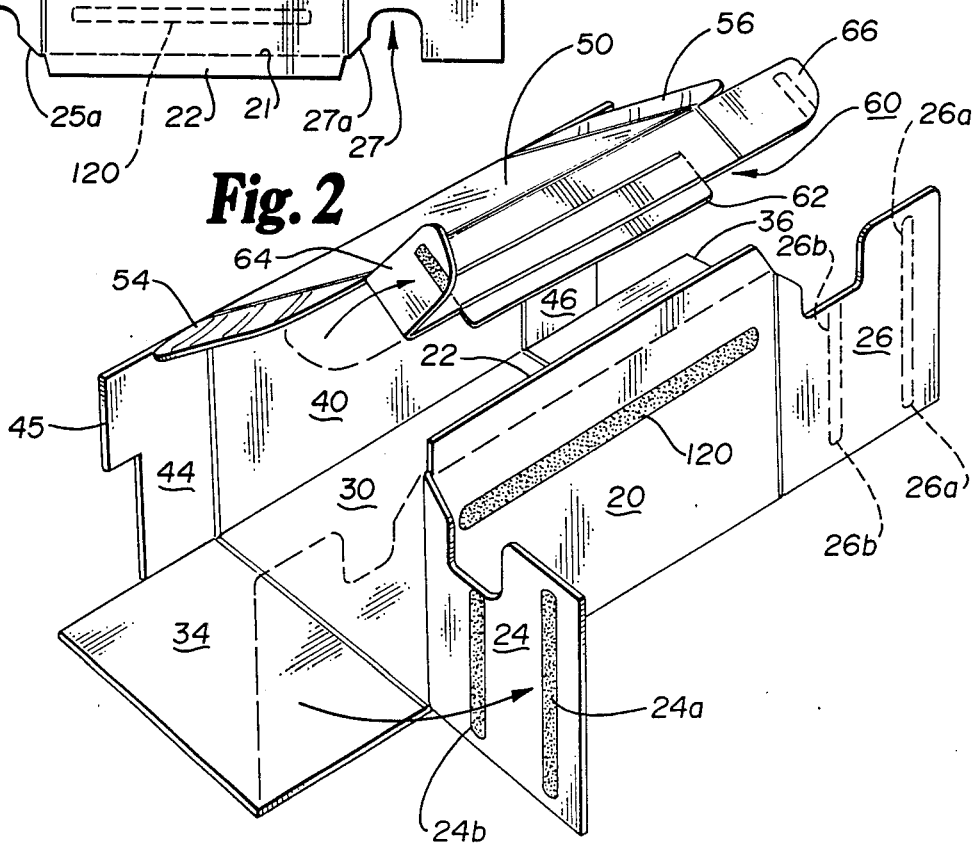
FIG. 2 is a perspective view of the carton blank bent in preparation for sealing of the manufacturer's joint.
Figure 3:
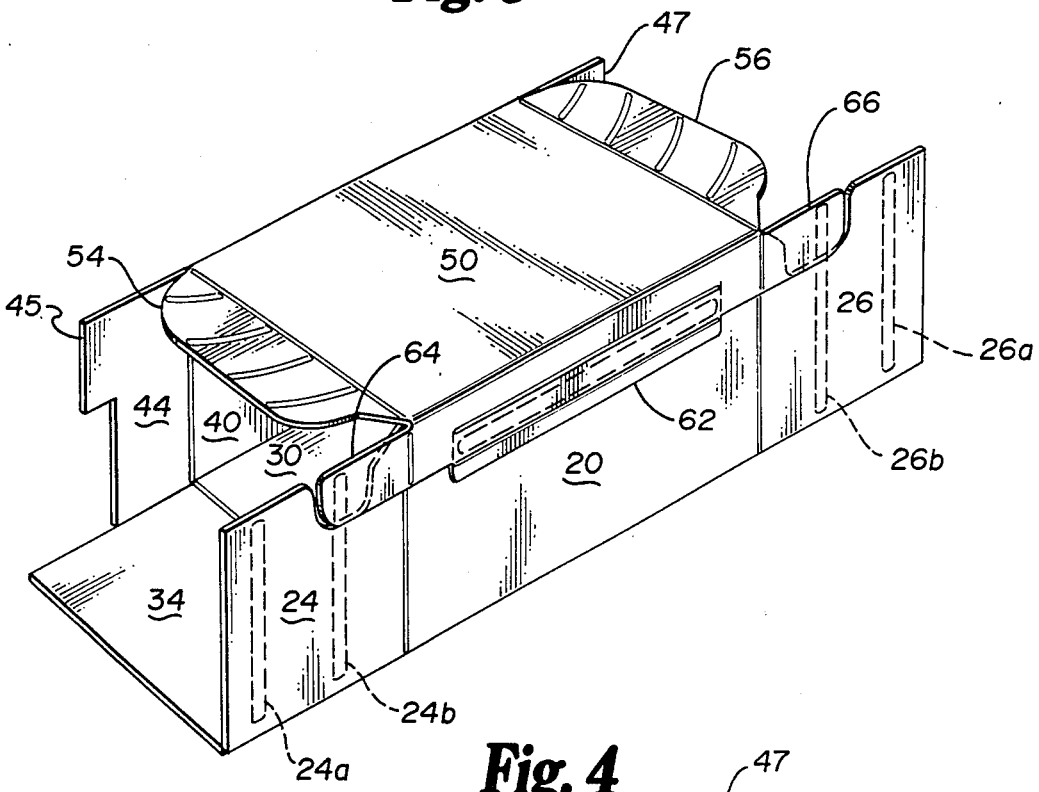
FIG. 3 is a perspective view of the carton at the first step of assembly of the endwalls.
Figure 4:
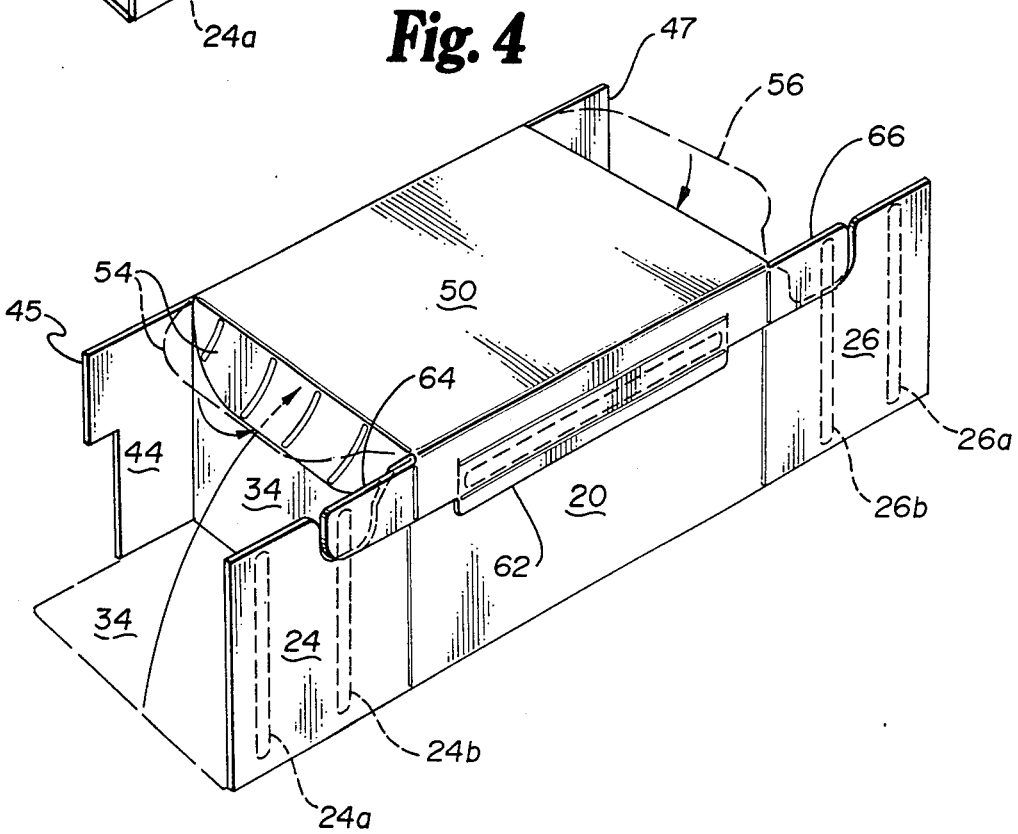
FIG. 4 is a perspective view of the carton at the second and third steps of assembly of the endwalls.
Figure 5:
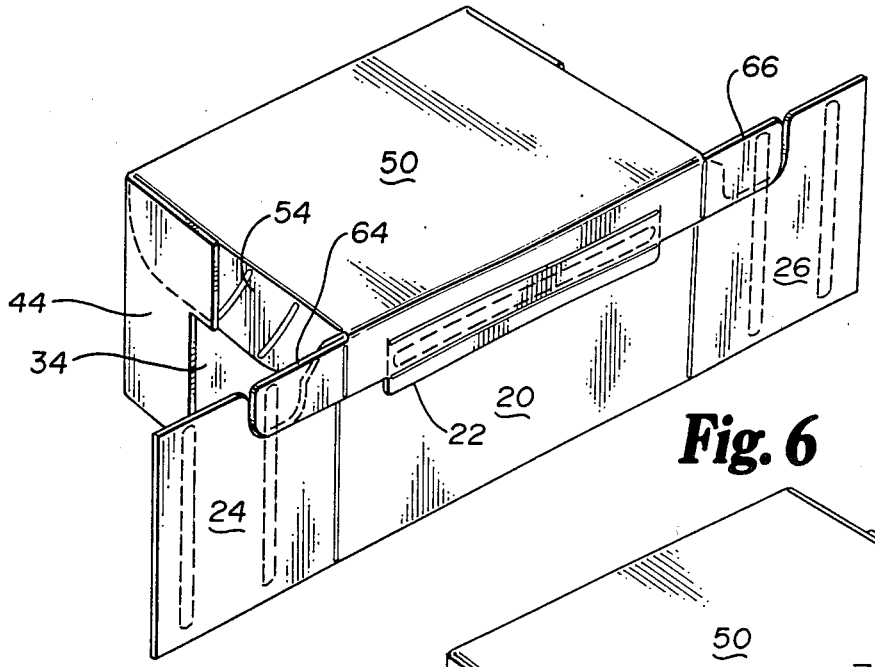
FIG. 5 is a perspective view of the carton at the fourth step of assembly of the endwalls.

As best seen in FIGS. 2–8, assembly of the flat blank 10 into a carton occurs by first forming a tube of rectangular cross section by erecting the front, bottom, back, cover and closure panels, 20, 30, 40, 50 and 60, respectively, at right angle folds at the first through fourth major fold lines 70–73. The carton is held in its tubular configuration by the contact adhesive 120 applied along the outside of the front panel 20. The contact adhesive 120 is positioned on the front panel 20 such that it contacts the closure flap 60 between the bend scores 75 and 76 (FIGS. 2, 3).

When the blank 10 has been erected (at the dairy) into the tubular configuration shown in FIG. 3, the closure endwall flaps 64, 66 overlap a portion of the front panel endwall flaps 24, 26, in particular, the area of U-shaped notches 25, 27. When the partially assembled carton is in this configuration, assembly of the right and left ends of the carton can proceed.

The folding sequence for the various endwall flaps when forming the ends of the cartons is as follows. Because the left and right ends are handled symmetrically, the sequence will be explained only with respect to the left endwall flaps, shown at the left side of FIG. 4. First, the bottom endwall flap 34 is folded upward at a 90 degree angle. In this position, the bottom endwall flap 34 substantially covers the entire tubular cross section. Second, the cover endwall insertion flap 54 is folded downward at a 90 degree angle to overlap the upper portion of the bottom endwall flap 34. Third, referring now to FIG. 5, the left rear endwall flap 44 is folded at a 90 degree angle so that it overlies the bottom and cover endwall flaps 34 and 54. Note that the rear endwall flap 44 includes an extension 45 that corresponds in width to the width of the cover endwall insertion flap 54. Adhesive is applied to the overlapping flaps 24 and 64 in two linear strips. The outer adhesive strip **24*a* extends transversely across the front endwall flap 24 near the outer edge of such flap. The inner adhesive strip 24*b* also applied to flap 24 is parallel to the corresponding first adhesive strip 24*a* but extends also onto the closure endwall flap 64 in the area of the U-shaped notch 25. With the adhesive strips 24***a*, 24*b* in place, the left end can now be completed and sealed.

Figure 6:
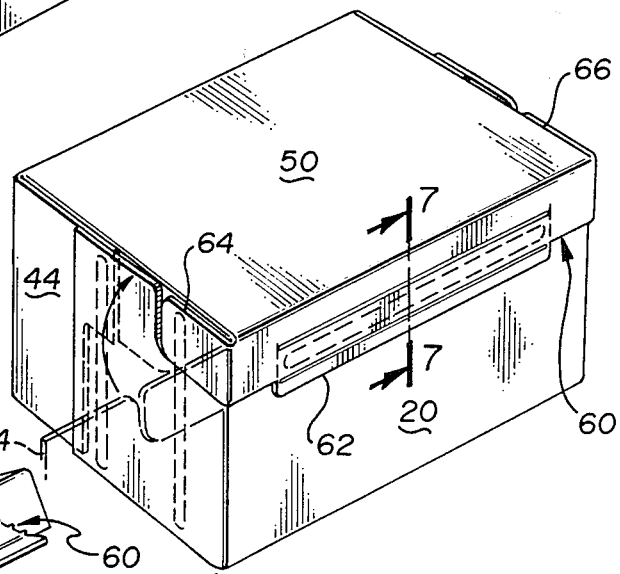
FIG. 6 is a perspective view of the carton at the fifth step of assembly of the endwalls.
Figure 7:
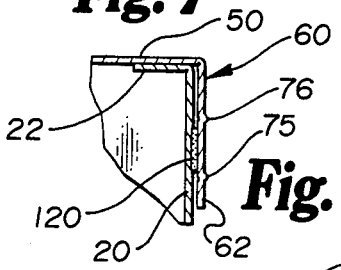
FIG. 7 is a partial sectional elevation taken along line 7—7 of FIG. 6.
Figure 8:
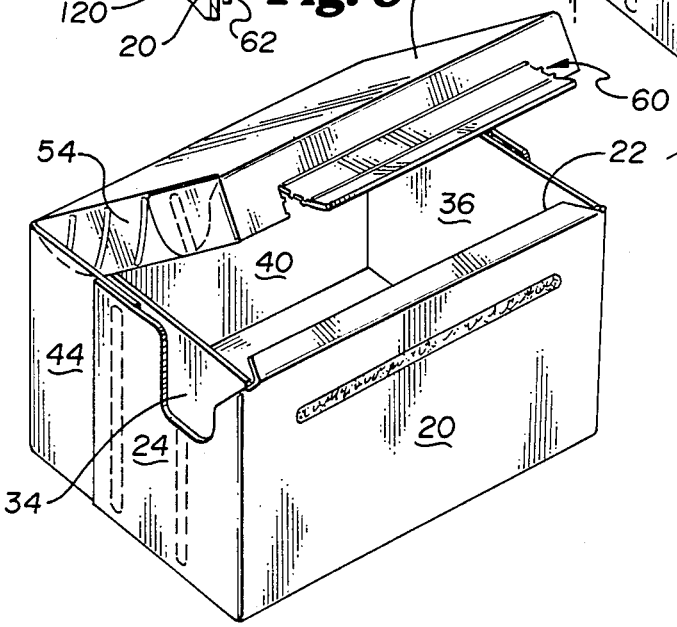
FIG. 8 is a perspective view of a completed and sealed carton being opened.

Referring now also to FIG. 6, the front endwall flap 24 and the corresponding closure endwall flap 64 are together folded at 90 degrees against the previously folded flaps 34, 54 and 44. At this point the adhesive strip 24*a* comes into contact with the lower portion of the bottom endwall flap 34 and the extension 45 of the rear endwall flap 44. The extension 45 keeps the adhesive strip 24*a* from contacting the cover endwall insertion flap 54. In addition, the adhesive strip 24*b* contacts the bottom endwall 34, except for that portion of the adhesive strip 24*b* placed on the closure endwall flap 64 in the U-shaped notch 25, which adheres to the cover endwall insertion flap 54 where this is exposed by the U-shaped notch 25.

The carton with one end sealed can now be filled with ice cream or other frozen dessert through the unsealed end. After a similar folding and glue application sequence has been used for the right endwall flaps 26, 36, 46, 56 and 66, the carton is erected and sealed. Following purchase, the carton may be opened by a consumer by lifting on the lip 62 of the closure panel 60 (which has not been glued) and tearing upward along the perforated lines 67, 68. Once the area between the fold lines 75, 76 is freed from the contact adhesive 120, the cover panel 50 may be lifted, because the extensions 45, 47 of the back endwall flaps 44, 46 have prevented the adhesive in strips 24*a* and 26*a* from adhering to the cover endwall insertion flaps 54, 56. At the same time, the closure endwall flaps 64, 66 have formed corners for a flip top hood or cover by adhering to the cover endwall insertion flaps 54, 56. Radial embossments 57, 59 aid in keeping the flip top hood or cover free to be lifted and reclosed.

In conclusion, when used in a conventional packaging equipment assembly line, the flat blank 10 of the present invention (with manufacturer's joint preglued) is first formed into a rectangular tube. Then, one set of endwall flaps is folded in the conventional sequence, with an adapter on the conventional equipment being used to seal that end. The carton is then filled at the opposed end and that end is sealed in a like manner. The completed and filled carton is shipped out for consumer purchase. Because access to the contents normally cannot be obtained without breaking one or more seals, in particular, the seal on closure flap 60, the purchaser can determine whether the carton seal is intact, thereby receiving an assurance that the carton has not been previously opened or tampered with. The configuration of the endwall and cover flaps provides a recloseable opening after the consumer breaks the closure flap seal.

Figure 9:
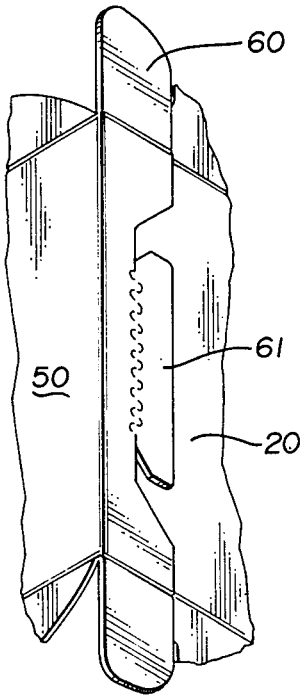
FIG. 9 is an alternative design for the closure panel of the present invention.

It will be seen by those skilled in the art that various changes may be made in the preferred embodiments shown above without departing from the scope of the invention. For example, it will be clear that the closure panel 60 can be connected to the front panel 20 at one or more tear-away tabs 61 as shown in FIG. 9. Release of the cover or hood would occur by separation of such a tear-away tab 61 from the closure panel 60, at its associated perforation line rather than by separation of the glued portion of the closure panel 60 from the front panel. (Similarly, in the closure panel embodiment shown in FIGS. 1–8, the fold line 76 could be made a perforated line connecting perforated lines 67, 68 to allow the entire flap area bounded by perforations to be separated from the closure panel 60.) The invention is therefore not limited to what is shown in the drawings and described in the specification but only as indicated in the appended claims.

What is claimed as new and desired to be secured by Letters Patent is:

1. A blank for forming a rectangular box carton comprising:

(a) a generally rectangular front panel having a first pair of endwall flaps attached thereto. at parallel, opposed sides of said front panel, each said endwall flap having a connection notch therein;

(b) a generally rectangular bottom panel connected to said front panel at a first major fold line, said bottom panel having a second pair of endwall flaps attached thereto at parallel, opposed sides of said bottom panel;

(c) a generally rectangular back panel connected to said bottom panel at a second major fold line parallel to said first major fold line, said back panel having a third pair of endwall flaps attached thereto at parallel opposed sides of said back panel with each such endwall flap having a glue shield extension thereon;

(d) a generally rectangular cover panel connected to said back panel at a third major fold line parallel to said first major fold line, said cover panel having a pair of endwall insertion flaps attached thereto at parallel opposed sides of said cover panel; and (e) a generally rectangular closure-panel connected to said cover panel at a fourth major fold line parallel to said first major fold line, said closure panel having a pair of corner flaps attached thereto at parallel, opposed edges of said closure panel and a tear flap extending from the side of said closure panel opposite said fourth major fold line, each said corner flap being adapted to align with at least a portion of a connection notch of an endwall flap of said front panel and to contact an underlying panel through said connection notch, when the front, bottom, back, cover and closure panels and the endwall flaps of the front, bottom and back panels and the endwall insertion flap of the cover panel are folded together to form a generally rectangular box carton with endwalls formed from overlying endwall flaps.

2. The blank as recited in claim 1 wherein the glue shield extension of each endwall flap of the back panel has a width greater than or equal to the width of the corresponding endwall insertion flap.

3. The blank as recited in claim 1 wherein each endwall insertion flap has one or more radial embossments thereon.

4. The blank as recited in claim 1 wherein the tear flap associated with the closure panel is joined to the edge of a cover seal glue area on said closure panel bounded at opposite ends by perforated tear lines that extend from the outer edge of the closure panel toward the fourth major fold line.

5. The blank as recited in claim 1 wherein the closure panel is affixed to the front panel adjacent the outer edge of the front panel by adhesive material in the cover seal glue area.

6. The blank as recited in claim 1 wherein the tear flap is attached to the remainder of the closure panel along a perforated tear line and is affixed to the front panel by adhesive material in the area of the tear flap bounded by the perforated tear line.

7. The blank as recited in claim 1 further comprising a selvage flap connected to said front panel along a fold line parallel to said first major fold line.

8. A rectangular box carton comprising:

(a) generally rectangular front, bottom, back, cover and closure panels, said front, bottom, back, cover and closure panels being consecutively joined at right angles at parallel fold lines and said closure panel being overlapped on and connected to said front panel to form a tube of generally rectangular cross section;

(b) left and right endwalls closing the ends of said tube, each endwall comprising:

(i) a first endwall flap attached to said bottom panel and covering substantially the entire tube cross section to form the innermost layer of each endwall;

(ii) a second endwall flap attached to said cover panel and lying adjacent said first endwall flap, said second flap overlapping only an upper portion of the first endwall flap;

(iii) a third endwall flap attached to said back panel and overlying a portion of said first and second endwall flaps, said third endwall flap overlying only the rear portion of said first and second endwall flaps an having a glue shield extension thereon that covers an additional portion of said second endwall flap;

(iv) a fourth endwall flap attached to said front panel and overlapping a portion of said first and second endwall flaps and the glue shield extension of the third endwall flap, said fourth endwall flap having a connection notch therein near an end of the fold line at which the cover and closure panels are joined, said connection notch exposing the corner of said second endwall flap nearest the closure panel; and (v) a fifth endwall flap attached to said closure panel, said fifth endwall flap overlying at least a portion of that corner of the second endwall flap that is exposed by the connection notch;

(c) a first adhesive strip applied to said fourth endwall flap substantially parallel to the foldline at which said fourth endwall flap is attached to the front panel, said first glue strip affixing said fourth endwall flap to the first endwall flap and the glue shield extension of the third endwall flap but not to the second endwall flap;

(d) a second adhesive strip applied to said fourth endwall flap and the fifth endwall flap substantially parallel to the foldline at which said fourth endwall flap is attached to the front panel, said second adhesive strip connecting said fourth endwall flap to the first endwall flap and said fifth endwall flap to the second endwall flap; and (e) a tear flap joined at the outer edge of said closure panel, said tear flap being connected to a glue area that forms a connection between said front panel and closure panel until said closure panel is released from said front panel upon opening of the carton.

9. The rectangular box carton recited in claim 8 wherein the glue shield extension of each third ehdwall flap has a width greater than or equal to the width of the corresponding second endwall flap.

10. The rectangular box carton recited in claim 8 wherein each second endwall flap has one or more radial embossments thereon.

11. The rectangular box carton recited in claim 8 wherein the tear flap joined at the outer edge of said closure panel is joined to the edge of a cover seal glue area on said closure panel bounded at opposite ends by perforated tear lines that extend from the outer edge of the closure panel toward the fourth major fold line.

12. The carton as recited in claim 8 wherein the closure panel is affixed to the front panel adjacent the outer edge of the front panel by adhesive material in the cover seal glue area.

13. The carton as recited in claim 8 wherein the tear flap is attached to the remainder of the closure panel along a perforated tear line and is affixed to the front panel by adhesive material in the area of the tear flap bounded by the perforated tear line.

14. The carton as recited in claim 8 further comprising a selvage flap connected to said front panel along a fold line parallel to said first major fold line.

* * * * *